US007540624B2

(12) United States Patent
Hull et al.

(10) Patent No.: US 7,540,624 B2
(45) Date of Patent: Jun. 2, 2009

(54) SPARE BATTERY HOLDER

(76) Inventors: Ricky Eugene Hull, 686 S. Sandusky St., #113, Tiffin, OH (US) 44883; Steven Lynn Batdorff, 21154 Mayapple Pl., Sterling, VA (US) 20164

( * ) Notice: Subject to any disclaimer, the term of this patent is extended or adjusted under 35 U.S.C. 154(b) by 0 days.

(21) Appl. No.: 11/496,475

(22) Filed: Aug. 1, 2006

(65) Prior Publication Data

US 2007/0030673 A1 Feb. 8, 2007

Related U.S. Application Data

(60) Provisional application No. 60/705,780, filed on Aug. 5, 2005.

(51) Int. Cl.
*F21L 4/00* (2006.01)

(52) U.S. Cl. ..... 362/202; 362/205; 362/208

(58) Field of Classification Search ..... 362/183, 362/184, 190, 191, 194, 195, 201, 202, 203, 362/204, 205, 206, 208
See application file for complete search history.

(56) References Cited

U.S. PATENT DOCUMENTS 3,885,148 A * 5/1975 Benedetto ..... 362/205
5,167,447 A * 12/1992 Gonzales ..... 362/208
5,188,450 A * 2/1993 Anderson ..... 362/194
5,197,796 A * 3/1993 Moore ..... 362/202
6,287,140 B1 * 9/2001 Itoh ..... 362/253
2005/0254234 A1 * 11/2005 Wang ..... 362/205
2007/0070620 A1 * 3/2007 Theriault et al. ..... 362/202

* cited by examiner

*Primary Examiner*—Y My Quach Lee
(74) *Attorney, Agent, or Firm*—Bacon & Thomas, PLLC

(57) ABSTRACT

Active and spare battery holders are removably disposed within a battery compartment of a battery operated device such that battery cells in the active holder provide electrical power to operate the device, while battery cells in the spare holder are electrically isolated to prevent their discharge. In one embodiment, upon discharge of the battery cells of the active holder the cells of the active holder and the spare holder are exchanged, providing the active holder with fresh cells to operate the device. In another embodiment, the active and spare holders are simply interchanged, so that the spare holder becomes the active holder and the active holder becomes the spare holder. According to the latter embodiment, a unitary battery holder includes a first and second battery holder in a single unit, so that to interchange active and spare holders the unitary battery holder is reversed within the battery compartment.

22 Claims, 5 Drawing Sheets

SPARE BATTERY HOLDER

This application claims the benefit of priority of U.S. provisional application No. 60/705,780 filed on Aug. 5, 2005.

FIELD OF THE INVENTION

The present invention relates to battery operated electrical devices, and more particularly to a spare battery holder for a battery operated electrical device such as a flashlight.

BACKGROUND

Battery operated electrical devices are limited in their use by the operational capacity or life of battery cells used for their operation. While advances in battery technologies have contributed to greater operational capacity, or a longer life, for battery cells, their discharge at some point remains inevitable.

Such a limitation is readily overcome by the provision of fresh batteries. However, it may be cumbersome or burdensome for a user of the battery operated electrical device to separately carry a spare set of battery cells.

Additionally, if spare battery cells are carried separately from the electrical device, the spare battery cells may be misplaced so that, in case that the battery cells of the electrical device become depleted, such separately located spare battery cells may be unavailable for replacement.

In certain environments, or for certain battery operated electrical devices, the loss of function of the electrical device presents only an inconvenience. However, in other environments, for example where safety equipment is concerned, loss of function of a battery operated electrical device may present a significant problem.

Accordingly, it is desirable to provide a battery operated electrical device with a spare battery holder that may be disposed within the battery operated electrical device along with battery cells that power the battery operated electrical device.

SUMMARY

Active and spare battery holders are removably disposed within a battery compartment of a battery operated device such that battery cells in the active holder provide electrical power to operate the device, while battery cells in the spare holder are electrically isolated to prevent their discharge.

In one embodiment, when battery cells of the active holder become discharged, the battery cells may be removed from the active holder and exchanged with battery cells from the spare battery holder to provide the active holder with fresh battery cells to continue operation of the device.

An active battery holder has positive and negative electrical terminals disposed on first and a second ends, respectively, of the active battery holder. The active battery holder has at least one active receptacle configured to removably receive a battery cell in an electrical circuit connected to the positive and negative electrical terminals.

A spare battery holder has positive and negative electrical terminals disposed on first and second ends, respectively, of the spare battery holder, and the positive and negative terminals are electrically connected to one another. The spare battery holder has at least one spare receptacle configured to removably receive a battery cell electrically isolated from said positive and negative terminals.

Electrical power is provided to the battery operated electrical device from battery cells of the active battery holder, while battery cells of the spare battery holder are isolated and remain un-discharged.

In another embodiment, the active and spare holders are simply interchanged, so that the spare holder becomes the active holder and the active holder becomes the spare holder. According to the latter embodiment, a unitary battery holder includes first and second battery holders in a single unit, so that to interchange active and spare holders the unitary battery holder is reversed within the battery compartment.

According to one variation, a battery operated electrical device has a battery compartment configured to removably receive at least a pair of battery holders. Positive and negative electrical contacts are disposed in the battery compartment and configured to receive electrical power to operate the battery operated electrical device.

First and second battery holders are configured to be removably received in the battery compartment. Each of the first and second battery holders comprise a first end and a second end, a positive and a negative electrical terminal disposed on the first end, and at least one receptacle configured to removably receive a battery cell in an electrical circuit in connection with the positive and negative electrical terminals.

The battery operated electrical device is operable by inserting one of the battery holders into the battery compartment with its positive and negative electrical terminals in contact with the positive and a negative electrical contacts, and inserting another one of the battery holders into the battery compartment with its positive and negative electrical terminals electrically isolated.

Thus, a battery operated electrical device may be supplied with a spare set of battery cells so that battery cells which are discharged during the use of the battery operated electrical device may be readily replaced for the continued operation of the battery operated electrical device.

These and other features, aspects, and advantages of the present invention will become better understood with regard to the following description, appended claims, and accompanying drawings.

BRIEF DESCRIPTION OF THE DRAWINGS

Similar reference characters denote corresponding features consistently throughout the attached drawings.

DETAILED DESCRIPTION OF VARIOUS EMBODIMENTS

Figure 1:
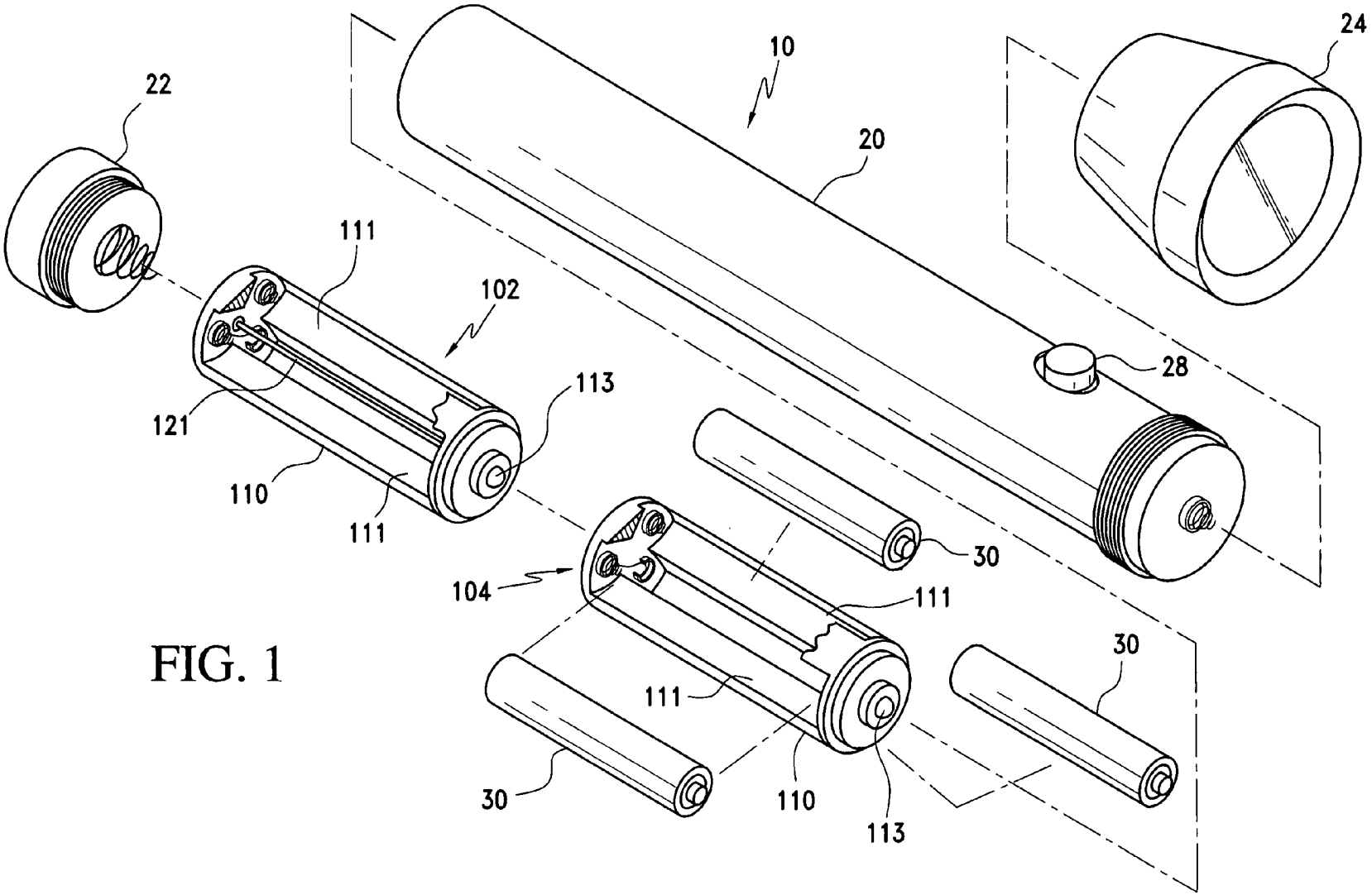
FIG. 1 is an exploded perspective view of a flashlight having a spare battery holder, according to a first embodiment of the present invention.
Figure 2:
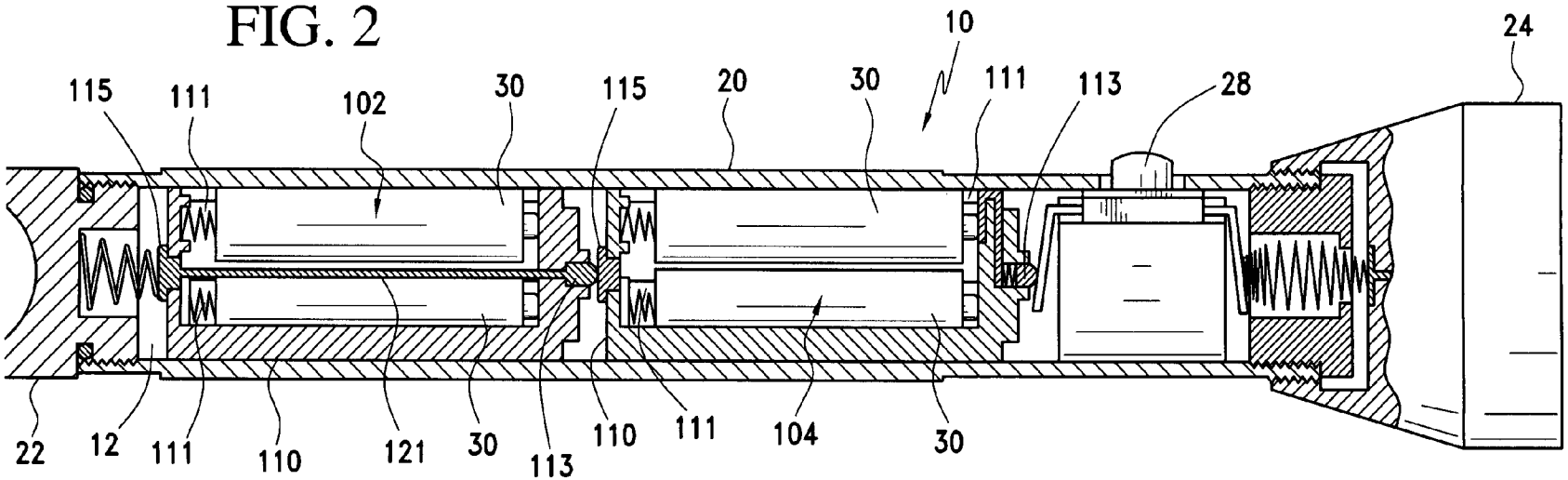
FIG. 2 is a section view of the embodiment of FIG. 1.
Figure 3:
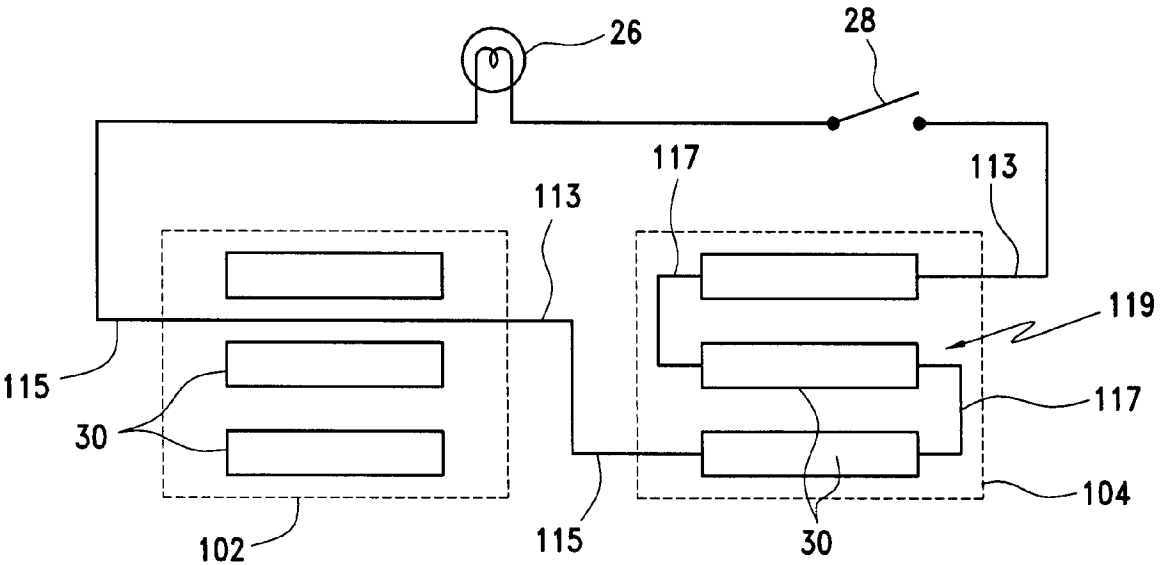
FIG. 3 is a schematic diagram of a flashlight electrical circuit of the embodiment of FIG. 1.

The present invention is a battery operated electrical device having a spare battery holder, designated generally as 10 in the figures. Referring to FIGS. 1-3, a battery operated electrical device 10 is shown as an embodiment of a flashlight. The battery operated electrical device 10 includes a spare battery holder 102 along with an active battery holder 104 disposed together within a battery compartment 12 of the battery operated electrical device 10.

Both the spare battery holder 102 and the active battery holder 104 comprise a battery holder 110 which may be configured in a physical size and shape similar to a conventional, standard battery cell, and thus may be used in a battery operated electrical device 10 that accommodates conventional, standard size batteries.

Each battery holder 110 is configured to hold at least one smaller, conventional, standard battery cell 30. For example, the spare battery holder 102 and the active battery holder 104 may have a physical size and shape similar to a standard C type battery, while each holds several standard AA type batteries. In the illustrated embodiment, each battery holder 110 is configured to hold three battery cells.

While configuring the battery holders 110 in the size and shape of a conventional, standard battery cell provides compatibility with existing battery operated electrical devices 10, the battery holders 110 may be provided in any non-standard size and shape for use with battery operated electrical devices 10 that are designed to accommodate the non-standard sized battery holders 110.

In the illustrated embodiment, each battery holder 110 is a generally cylindrically shaped body having length and width (diametric) dimensions that mimic or approximate the length and width (or diameter) of a standard flashlight-type battery (C cell, D cell, or the like).

Each battery holder 110 comprises at least one receptacle 111 having physical dimensions to accommodate a battery cell 30, such that each receptacle is configured to removably receive and retain a battery cell 30. In the illustrated embodiment, a plurality of receptacles are provided in each battery holder 110 such that each battery holder 110 holds a plurality of battery cells 30.

The active battery holder 104 has a positive terminal 113 and a negative terminal 115 disposed at opposite ends of the active battery holder 104 in a manner similar to (and compatible with) a conventional battery. The active battery holder 104 is provided with electrical interconnections 117 disposed in the receptacles 111.

The electrical interconnections 117 define an electrical circuit 119 in connection with the positive 113 and negative 115 terminals such that a plurality of battery cells 30 held within the active battery holder 104 are connected to provide electrical power to the positive 113 and negative 115 terminals.

The electrical interconnections include contacts located at opposite ends of the receptacles 111 or otherwise configured to make contact with the electrical poles or contacts of a battery cell received in a receptacle 111. The interconnections 117 may connect the battery cells either in series or in parallel, depending upon the arrangement of the electrical interconnections 117.

The spare battery holder 102 has a positive terminal 113 and a negative terminal 115 configured at opposite ends of the active battery holder 104 in a manner similar to (and compatible with) a conventional battery. However, unlike the active battery holder 104, no electrical interconnections are provided for battery cells 30 held within the spare battery holder 102. Instead, a single electrical connection 121 is provided between the positive 115 and negative 117 terminals.

Accordingly, when a spare battery holder 102 and an active battery holder 104 are placed into a battery operated electrical device 10, the active battery holder 104 provides electrical power (from the battery cells 30 contained therein) while the spare battery holder 102 simply completes an electrical circuit, but does not supply any electrical power. Thus, the battery cells 30 of the active battery holder 104 power the electrical device, while the battery cells 30 of the spare battery holder 102 are simply stored for future use.

When battery cells 30 of the active battery holder 104 are depleted, a user of the battery operated electrical device 10 may transfer battery cells 30 from the spare battery holder 102 to the active battery holder 104 for continued operation of the electrical device. The depleted battery cells 30 removed from the active battery holder 104 may be discarded, or placed in the spare battery holder 102 to be discarded at a later time.

A flashlight configured to use the spare battery holder 102 and the active battery holder 104 according to the embodiment of FIGS. 1-3 is a flashlight of a generally conventional configuration, comprising an elongated cylindrical body 20 having a hollow interior that forms a battery compartment 12 for holding a plurality of battery cells in an inline configuration.

An end cap 22 forms a closure for the rear end of the body 20, and a head portion (or lamp assembly) 24 is removably attached at the front end of the body. The head portion 24 includes at least one lamp 26, and may contain plural lamps 26 which may be incandescent, LED, halogen, or other lamp types. The head portion 24 may also include a reflector, lens, or other elements to amplify, focus, diffuse, or otherwise modify light emitted from the lamp 26.

A switch 28 is disposed on or in the body 20 to turn the lamp 26 on and off.

Figure 4:
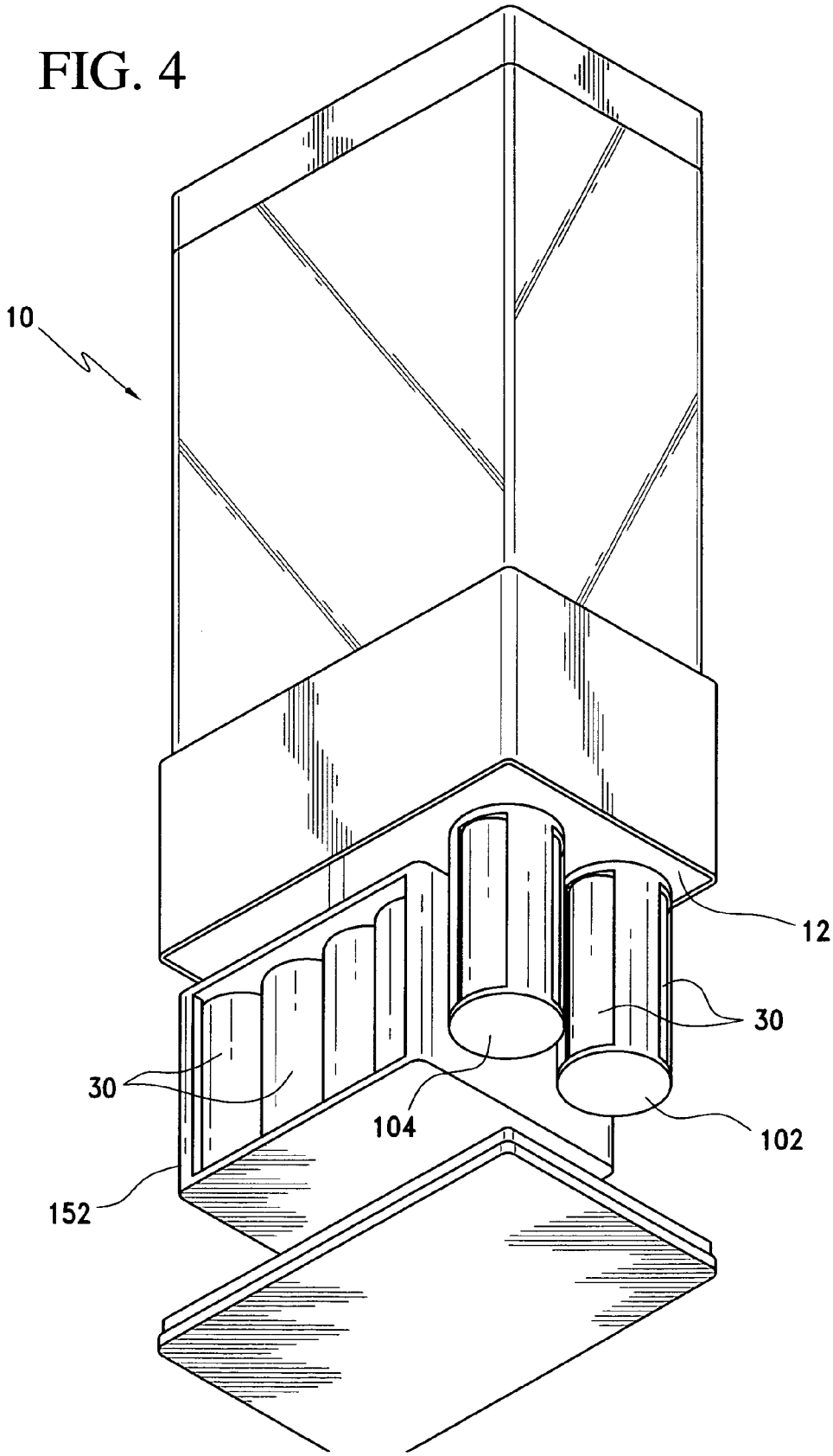
FIG. 4 is an exploded perspective view of a battery operated electrical device showing an alternate arrangement of battery holders within a battery compartment.

Referring to FIG. 4, a battery operated electrical device 10 is shown wherein a battery compartment 12 has a rectangular configuration to receive a plurality of batteries or spare and active battery holders 102, 104 in a side-by-side configuration.

Additionally, an alternatively configured battery holder 152 is shown wherein the alternative configuration is a rectangular shape. The alternatively configured battery holder 152 may be configured as an active battery holder having active battery receptacles, or as a spare battery holder having spare battery receptacles. In another possible configuration, the battery holder 152 may include both active and spare battery receptacles. Other configurations than those illustrated are possible.

Figure 5:
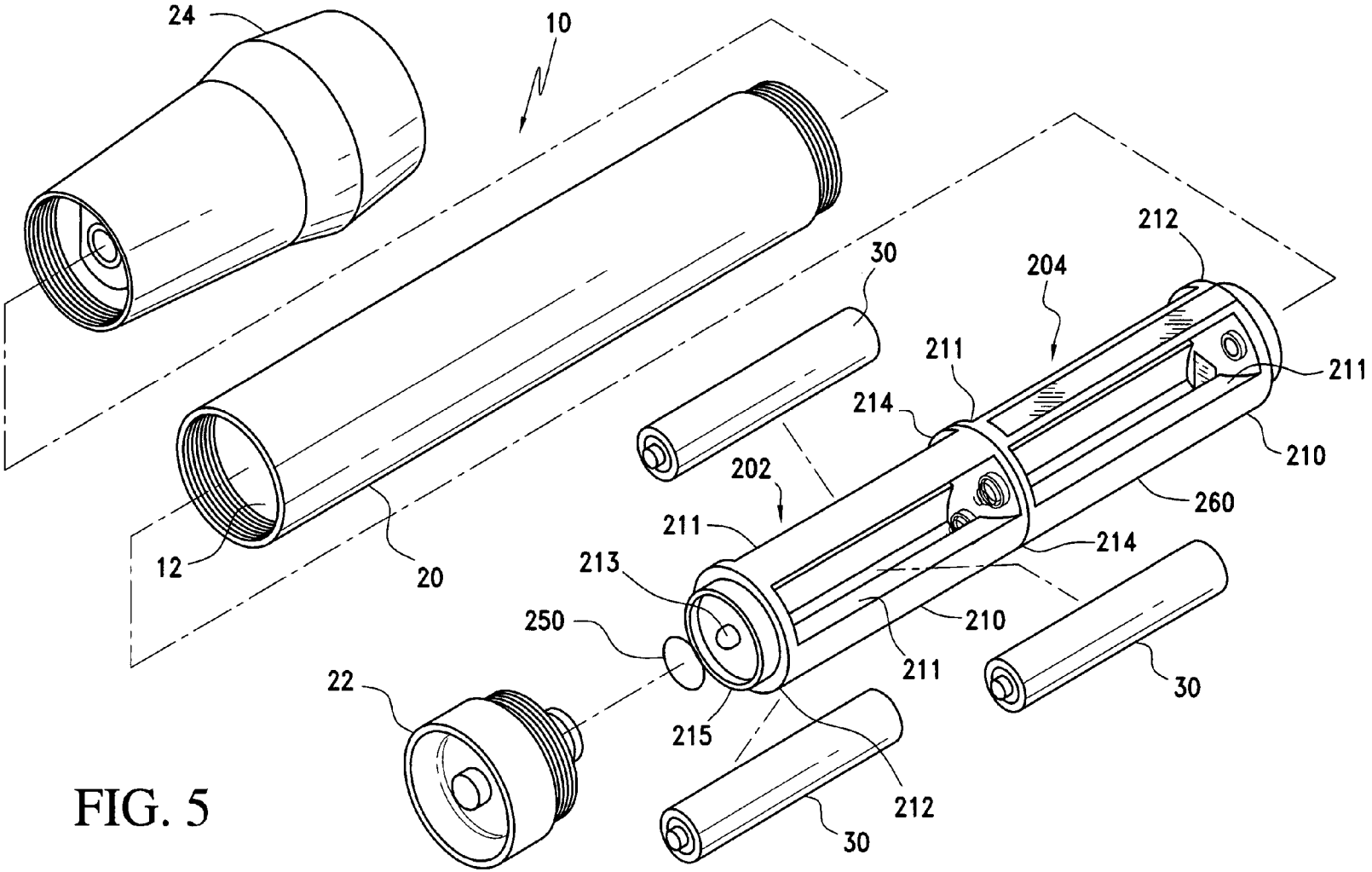
FIG. 5 is an exploded perspective view of a flashlight having a spare battery holder, according to a second embodiment of the present invention.
Figure 6:
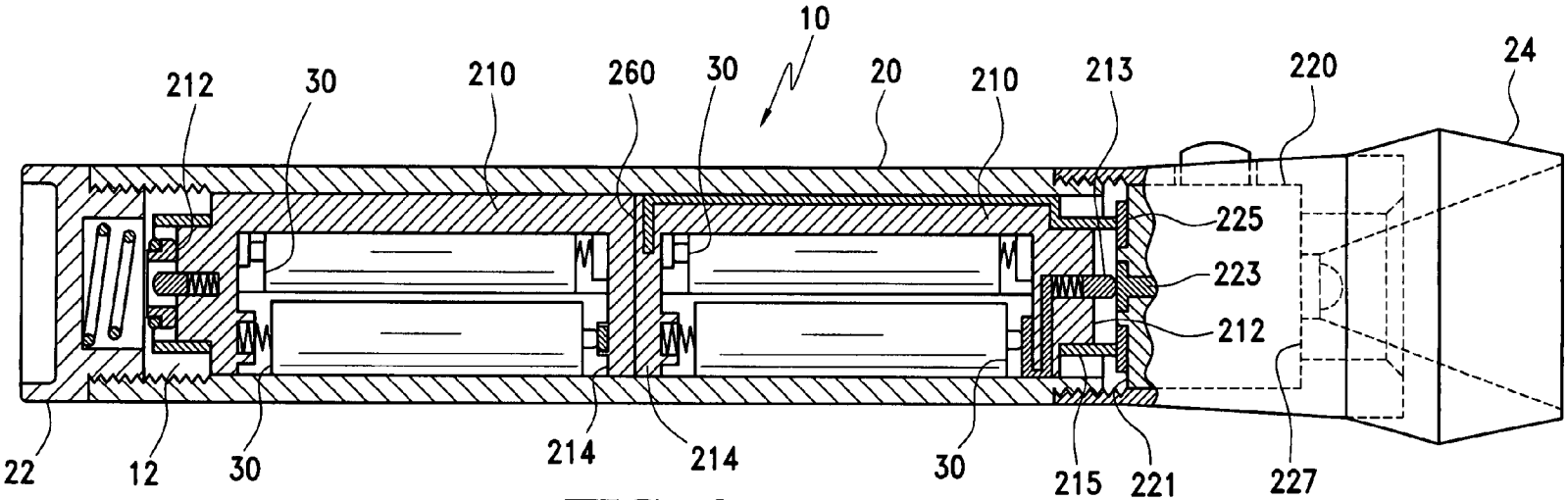
FIG. 6 is a section view of the embodiment of FIG. 5.
Figure 7:
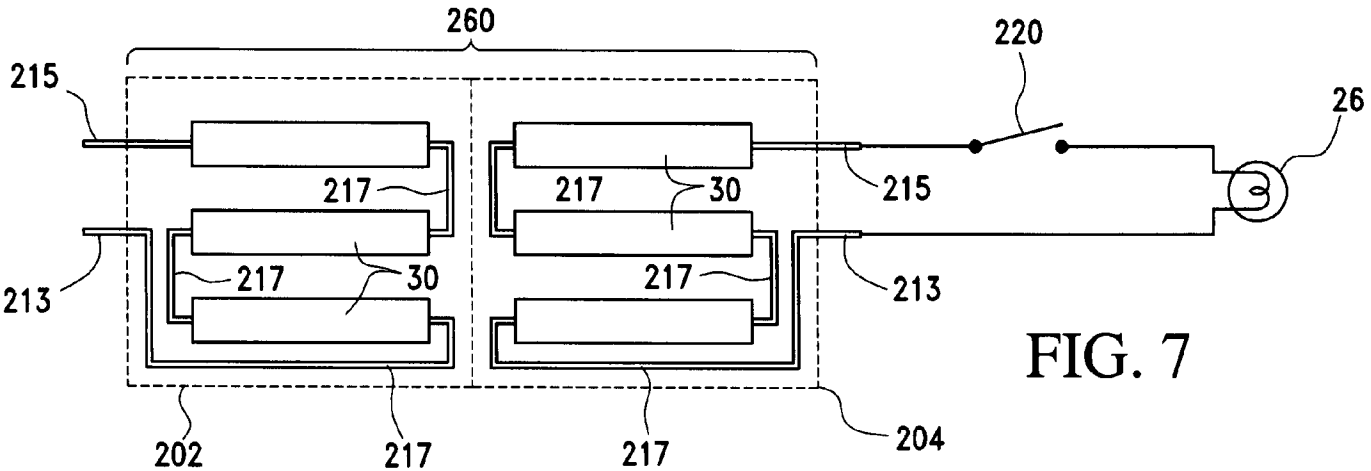
FIG. 7 is a schematic diagram of a flashlight electrical circuit of the embodiment of FIG. 5.

Turning to FIGS. 5-7, another embodiment is illustrated wherein a single battery holder 210 configuration serves as both a spare battery holder 202 and as an active battery holder 204.

In the illustrated embodiment, battery holders 210 comprise a generally cylindrically shaped body having length and width (diametric) dimensions that mimic or approximate the length and width (or diameter) of a standard flashlight-type battery (C cell, D cell, or the like).

Battery holders 210 comprise at least one receptacle 211 having physical dimensions to accommodate a battery cell 30, such that each receptacle 211 is configured to removably receive and retain a battery cell 30. In the illustrated embodiment, a plurality of receptacles 211 are provided in each battery holder 210 such that each battery holder 210 holds a plurality of battery cells 30.

The battery holders 210 comprise positive 213 and negative 215 terminals disposed on a first end 212 of the battery holder 210, as opposed to the previously described embodiment wherein positive 113 and negative 115 terminals are located at opposite ends of the active battery holder 104. A second end of the battery holders 210 has no terminals.

The positive terminal 213 is a single terminal in the form of a post, protrusion, or the like located in the center of the first end 212 of the battery holder 210 in the manner of the positive terminal of a conventional battery cell.

The negative terminal 215 is located at the perimeter of the first end 212 of the battery holder 210. In the illustrated embodiment, the negative terminal 215 is ring-shaped to extend around the entire perimeter of the end of the battery holder 210, although the shape and position of both of the battery terminals may be varied.

Electrical connections 217 are provided in the battery holders 210 such that a plurality of battery cells 30 disposed in the receptacles 211 are received in an electrical circuit 219 in connection with the positive 213 and negative 215 electrical terminals. The battery cells 30 may be connected in a parallel or series configuration.

A flashlight configured to use battery holders 210 according to the embodiment of FIGS. 4-6 is a flashlight of a generally conventional configuration, comprising an elongated cylindrical body 20 having a hollow interior that forms a battery compartment 12 for holding a plurality of battery cells in an inline configuration.

An end cap 22 forms a closure for the rear end of the body 20, and a head portion (or lamp assembly) 24 is removably attached at the front end of the body 20. The head portion 24 includes at least one lamp 26, and may contain plural lamps 26 which may be incandescent, LED, halogen, or other lamp types. The head portion 24 may also include a reflector, lens, or other elements to amplify, focus, diffuse, or otherwise modify light emitted from the lamp 26.

A switch 220 is disposed in the body 20 to turn the lamp 26 on and off. The switch 220 comprises a first end face 221 having positive 223 and a negative 225 contacts which are arranged to match, and make contact with, the positive 213 and negative 215 terminals of a battery holder 210 placed with its first end 212 against the first end face 221 of the switch 220.

A second end face 227 of the switch 220 also has positive and negative contacts which contact positive and negative contacts of the head portion 24. The positive and negative contacts of the head portion 24 are electrically connected to the lamp 26.

The switch 220 is disposed in the front end of the body 20, between the lamp assembly 24 and the battery compartment 12, such that the first end face 221 of the switch 220 forms an end wall of the battery compartment 12, and provides the battery compartment with electrical contacts whereby a battery holder 210 placed within the battery compartment provides electrical power to operate the flashlight.

It can be seen that a first battery holder 210 provided in the battery compartment 12 of the flashlight body 20, and having its first end 212 placed against the first end face 221 of the switch 220, provides electrical power to illuminate the lamp 26, from battery cells 30 placed within the receptacles 211 of the battery holder 210. Thus, the first battery holder 210 so positioned functions as an active battery holder 204 powering the flashlight.

A second battery holder 210 may be provided within the battery compartment 12 of the flashlight body 20 to provide a spare set of battery cells 30. An insulating member 250 may be provided, as necessary, to prevent the terminals 213, 215 of the second battery holder 110 from making electrical contact with the body 20, end cap 22, or other battery holder 210 so that battery cells 30 placed within the receptacles of the second battery holder 210 are not drained. Thus, the second battery holder 210 so positioned functions as a spare battery holder 202 providing a source of fresh battery cells 30.

It can be recognized that, once the battery cells 30 of the active battery holder 204 are drained, the active and spare battery holders 204, 202 may be simply swapped in position so that terminals 213, 215 of the first end 212 of the spare battery holder 202 are brought into contact with the terminals 223, 225 of the first face 221 of the switch 220, so that the spare battery holder 202 becomes the active battery holder 204 powering the flashlight.

A first and second battery holder 210 may be combined into a single unit 260 by fixing the first and second battery holders 210 together at their respective second ends 214. The single unit 260 may be placed into the flashlight body 20, and simply removed, reversed, and replaced when the battery cells of one of the battery holder portions are depleted.

It will be understood that the above-described embodiments of the invention are illustrative in nature, and that modifications thereof may occur to those skilled in the art. Accordingly, this invention is not to be regarded as limited to the embodiments disclosed herein, but is to be limited only as defined in the appended claims.

We claim:

1. A battery holder kit providing spare battery storage, comprising:

an active battery holder having a positive and a negative electrical terminal disposed on a first and a second end, respectively, of said active battery holder, at least one active receptacle configured to removably receive a battery cell in an electrical circuit connected to said positive and negative electrical terminals;

a spare battery holder separate from said active battery holder having a positive and a negative electrical terminal disposed on a first and a second end, respectively, of said spare battery holder, an electrical conductor connecting the positive and negative electrical terminals of the spare battery holder to one another, and at least one spare receptacle formed in the spare battery holder and configured to removably receive a battery cell such that electrical terminals of the battery are electrically isolated from said positive and negative terminals of the spare battery holder.

2. The battery holder kit according to claim 1, wherein said at least one active receptacle comprises a plurality of active receptacles.

3. The battery holder kit according to claim 1, wherein said at least one spare receptacle comprises a plurality of spare receptacles.

4. The battery holder kit according to claim 1, wherein said active battery holder and said spare battery holder are each generally cylindrical.

5. The battery holder kit according to claim 4, wherein said active battery holder and said spare battery holder each have a shape and dimensions corresponding to a standard flashlight-type battery cell.

6. The battery holder kit according to claim 1, wherein said active battery holder and said spare battery holder are each generally rectangular.

7. A spare battery flashlight, comprising:

a flashlight body containing a battery compartment;

a lamp assembly disposed on said flashlight body;

an active battery holder removably disposed in said battery compartment, the active battery holder having a positive and a negative electrical terminal disposed on a first and a second end, respectively, of said active battery holder, and at least one active receptacle configured to removably receive a battery cell in an electrical circuit in connection with said positive and negative terminals;

a spare battery holder removably disposed in said battery compartment, the spare battery holder having a positive and a negative electrical terminal disposed on a first and a second end, respectively, of said spare battery holder and electrically connected to one another, and at least one spare receptacle configured to removably receive a battery cell such that electrical terminals of the battery are electrically isolated from said positive and negative terminals of the spare battery holder; and at least one electrical interconnection disposed in said flashlight body and configured to define, along with said active and spare battery holders, an electrical circuit for powering a lamp disposed in said lamp assembly.

8. The spare battery flashlight according to claim 7, wherein said flashlight body is a cylindrical body, and wherein said lamp assembly is disposed on a first end of the cylindrical body.

9. The spare battery flashlight according to claim 8, further comprising an end cap disposed on a second end of said cylindrical body.

10. The spare battery flashlight according to claim 8, wherein said active and spare battery holders are receivable within said cylindrical body in an inline configuration.

11. The spare battery flashlight according to claim 7, wherein said active and spare battery holders are receivable within said flashlight body in a side-by-side configuration.

12. A battery operated electrical device providing spare battery storage, comprising:

an electrical device having a battery compartment configured to removably receive at least a pair of battery holders;

a positive and a negative electrical contact disposed in said battery compartment and configured to receive electrical power to operate said electrical device;

first and second battery holders configured to be removably received in said battery compartment, the first and second battery holders each having a first end and a second end, a positive and a negative electrical terminal disposed on said first end, and at least one receptacle configured to removably receive a battery cell in an electrical circuit in connection with said positive and negative electrical terminals;

wherein said electrical device is operable by inserting one of said battery holders into said battery compartment with its positive and negative electrical terminals in contact with said positive and negative electrical contacts, and inserting another one of said battery holders into said battery compartment with its positive and negative electrical terminals electrically isolated from the positive and negative electrical terminals of the one battery holder.

13. The battery operated electrical device according to claim 12, wherein said battery compartment is configured to removably receive at least a pair of battery holders in an inline configuration.

14. The battery operated electrical device according to claim 13, wherein said first and second battery holders are joined together at their respective second ends to form a unitary battery holder, whereby the first and second battery holders may be interchanged within said battery compartment by removing, reversing, and replacing the unitary battery holder.

15. The battery operated electrical device according to claim 12, wherein for each of said first and second battery holders, said positive terminal is disposed in a center of said first end.

16. The battery operated electrical device according to claim 12, wherein for each of said first and second battery holders, said negative terminal is disposed at a perimeter of said first end.

17. The battery operated electrical device according to claim 12, wherein said positive and negative electrical contacts are disposed on a side face of a switch disposed at one end of said battery compartment.

18. The battery operated electrical device according to claim 17, wherein said battery operated electrical device is a flashlight comprising a flashlight body containing said battery compartment, a lamp assembly disposed on a first end of said flashlight body, said switch being positioned between said battery compartment and said lamp assembly, the switch being configured to complete an electrical circuit between said positive and negative electrical contacts and said lamp assembly.

19. The battery operated electrical device according to claim 18, further comprising an end cap removably disposed on a second end of said flashlight body, and an insulating member disposed between said end cap and said battery compartment.

20. A battery holder, comprising:

a battery holder body having a first end and a second end;

at least one first positive and at least one first negative electrical terminal disposed on said battery holder body, and at least one second positive and at least one second negative electrical terminal disposed on said battery holder body;

at least one of said first positive and first negative electrical terminals being electrically isolated from a corresponding one of said second positive and second negative electrical terminals; and at least one first battery receptacle configured to removably receive a battery cell in an electrical circuit connected to said first positive and first negative electrical terminals, and at least one second battery receptacle in said battery holder body configured to removably receive a battery cell in an electrical circuit connected to said second positive and second negative electrical terminals;

wherein said battery holder body has a shape and dimensions corresponding to at least one standard battery cell.

21. The battery holder of claim 20, wherein said first positive and negative terminals are disposed at the first end of said battery holder body, and said second positive and negative terminals are disposed at the second end of said battery holder body.

22. A spare battery flashlight, comprising:

a flashlight body containing a battery compartment;

a lamp assembly disposed on said flashlight body;

a battery holder body removably insertable into said battery compartment, a first positive and a first negative electrical terminal disposed on said battery holder body and a second positive and a second negative electrical terminal disposed on said battery holder body;

at least one of said first positive and first negative electrical terminals being electrically isolated from a corresponding one of said second positive and second negative electrical terminals; and at least one first battery receptacle configured to removably receive a battery cell in an electrical circuit connected to said first positive and first negative electrical terminals, and at least one second battery receptacle configured to removably receive a battery cell in an electrical circuit connected to said second positive and second negative electrical terminals;

a positive and a negative electrical terminal disposed within said battery compartment and arranged to make contact with the first positive and negative electrical terminals of said battery holder body when the battery holder body is inserted into the battery compartment in a first position, and to make contact with the second positive and negative electrical terminals of said battery holder body when the battery holder body is inserted into the battery compartment in a second position; and at least one electrical interconnection disposed in said flashlight body and connected to the positive and a negative electrical terminal disposed within said battery compartment to define an electrical circuit for powering a lamp disposed in said lamp assembly.

* * * * *